US010687407B2

(12) United States Patent
Rademakers et al.

(10) Patent No.: US 10,687,407 B2
(45) Date of Patent: Jun. 16, 2020

(54) WIRELESS LUMINAIRE CONFIGURATION

(71) Applicant: SIGNIFY HOLDING B.V., Eindhoven (NL)

(72) Inventors: Patrick Rademakers, Eindhoven (NL); Marco Haverlag, Eindhoven (NL); Ralph Antonius Cornelis Braspenning, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/327,216

(22) PCT Filed: Jul. 28, 2017

(86) PCT No.: PCT/EP2017/069137
§ 371 (c)(1),
(2) Date: Feb. 21, 2019

(87) PCT Pub. No.: WO2018/036749
PCT Pub. Date: Mar. 1, 2018

(65) Prior Publication Data

US 2019/0230774 A1 Jul. 25, 2019

(30) Foreign Application Priority Data

Aug. 23, 2016 (EP) ..... 16185295

(51) Int. Cl.
*H05B 47/19* (2020.01)
*G08C 23/04* (2006.01)

(52) U.S. Cl.
CPC ..... *H05B 47/19* (2020.01); *G08C 23/04* (2013.01)

(58) Field of Classification Search
CPC ..... H05B 37/0272; G08C 23/04
See application file for complete search history.

(56) References Cited

U.S. PATENT DOCUMENTS

2003/0107888 A1 6/2003 Devlin et al.
2008/0247759 A1 10/2008 Bahar
(Continued)

FOREIGN PATENT DOCUMENTS

WO 2012090122 A1 7/2012
WO 2014053929 A1 4/2014

*Primary Examiner* — Renan Luque
*Assistant Examiner* — Jianzi Chen
(74) *Attorney, Agent, or Firm* — Akarsh P. Belagodu

(57) ABSTRACT

A luminaire (10) is disclosed comprising a wireless communication module (13) for configuring the luminaire; an optical signal detector (11) for detecting a directional optical signal (31) comprising source information included in the directional signal by a signal source (20) of the directional signal; and a controller (15) for controlling the wireless communication module. The controller is adapted to decode the source information of the coded directional optical signal to extract an identification code and a cryptographic key; to enable the wireless communication module such as to establish a wireless communication link (33) between the wireless communication module and the signal source if the extracted code matches a reference code; and to encrypt data sent over the wireless communication link (33) in accordance with said cryptographic key. A method for communicating with such a luminaire, a computer program product for implementing such a method and a mobile communications device comprising the computer program product are also disclosed.

10 Claims, 7 Drawing Sheets

(56) References Cited

U.S. PATENT DOCUMENTS

| | | | | |
|---|---|---|---|---|
| 2010/0045205 | A1 | 2/2010 | Bergman et al. | |
| 2013/0051806 | A1 | 2/2013 | Quilici et al. | |
| 2013/0063027 | A1* | 3/2013 | Recker | H05B 33/0803 315/86 |
| 2013/0223279 | A1* | 8/2013 | Tinnakornsrisuphap | H04L 41/0809 370/254 |
| 2013/0342111 | A1 | 12/2013 | Mohan | |
| 2014/0239816 | A1 | 8/2014 | Lee et al. | |
| 2015/0022325 | A1* | 1/2015 | Talstra | G08C 17/02 340/10.5 |
| 2015/0173154 | A1 | 6/2015 | Faulkner | |
| 2015/0263861 | A1* | 9/2015 | Kumar | H04B 10/116 713/168 |
| 2016/0270195 | A1* | 9/2016 | Ikehara | H05B 47/19 |
| 2017/0142809 | A1* | 5/2017 | Paolini | H05B 33/086 |
| 2018/0332692 | A1* | 11/2018 | Feil | H04B 10/116 |

* cited by examiner

100

WIRELESS LUMINAIRE CONFIGURATION

CROSS-REFERENCE TO PRIOR APPLICATIONS

This application is the U.S. National Phase application under 35 U.S.C. § 371 of International Application No. PCT/EP2017/069137, filed on Jul. 28, 2017, which claims the benefit of European Patent Application No. 16185295.9, filed on Aug. 23, 2016. These applications are hereby incorporated by reference herein.

FIELD OF THE INVENTION

The present invention relates to a luminaire comprising a wireless communication module for configuring the luminaire and a signal detector for detecting an activation signal.

The present invention further relates to a method of establishing a communication with such a luminaire.

The present invention yet further relates to a computer program product for implementing such a method.

The present invention still further relates to a mobile communications device comprising a processing arrangement for executing computer program code of such a computer program product.

BACKGROUND OF THE INVENTION

In recent years a migration is taking place from simple non-connected light sources towards systems of inter-connected light sources (luminaires) that communicate with each other and with external systems, e.g. over a network. For retrofit applications, e.g. in office buildings or for retrofitting existing street lights, it is beneficial that a wireless network is used for this communication. For this purpose, each luminaire is equipped with a wireless communication module, e.g. a wireless node. This avoids the need for drawing network cables between the luminaires. In order to compose groups of luminaires that communicate with each other over such a wireless network, a commissioning process may be required in which each luminaire is configured through its wireless communication module to provide the luminaire with the knowledge to which group it belongs.

In order to perform such commissioning, a temporary connection must be made with each luminaire in order to open a network, add luminaires to a network and finally close the network. After this, often some further configuration of luminaires may be required, such as configuration of sensor properties and/or reactions to it. This process is sometimes simply called configuration.

U.S. Pat. No. 0,107,888 discloses a luminaire after an optical receiver in such a way a remote control with an optical pointer can trigger an RF interface the luminaire in such a way to control this luminaire and not another luminaire in the same RF range.

In cases where the luminaire is a standalone fixture, only the configuration step may be necessary. An example of such a case is a light point which is controlled using a point-to-point wireless connection such as Bluetooth.

One interesting example of such luminaire configuration is the unlocking of features that are already present in the hardware and software of the wireless communication module, but only become active once the customer has paid the appropriate subscription or activation fee. Such 'feature unlocking' should be done in a secure way in order to safeguards investments. The same is true for updates of the software over the air. In both scenarios the installer may need to establish a connection to a particular luminaire in an environment where multiple luminaires may be in reach of the wireless connection, such that it is necessary to select the appropriate luminaire for wirelessly communicating with.

An example of such a selection method is for example disclosed in FIG. 3 of US 2013/0342111 A1, where a method of providing user control of an environmental parameter of a structure such as a light fixture is disclosed. The method includes establishing a light-based direct communication link between a user device and a fixture located within the structure, the fixture identifying itself by a wireless first communication link, e.g. Bluetooth or Wi-Fi, to the user device by sending a broadcast/multicast message, the user device using this identification to send control information to the fixture using the first communication link.

However, such a selection mechanism has security concerns because even although the triggering of the communication is made by the user device, the broadcasting of the luminaire can be received by other devices, which may trigger such other devices to eaves drop for example. Therefore, this mechanism is unsuitable in situations where it may be necessary to ensure that the connection cannot be tampered with, e.g. outdoor situations.

SUMMARY OF THE INVENTION

The present invention seeks to provide a luminaire that may be configured in a more secure manner.

The present invention further seeks to provide a method of establishing a secure communication with such a luminaire.

The present invention yet further seeks to provide a computer program product for implementing such a method.

The present invention still further seeks to provide a mobile communications device comprising a processing arrangement for executing computer program code of such a computer program product.

According to an aspect, there is provided a luminaire comprising a wireless communication module for configuring the luminaire; an optical signal detector for detecting a directional optical signal comprising source information included in the directional optical signal by a signal source of the directional optical signal; and a controller for controlling the wireless communication module. The controller is adapted to decode the source information of the coded directional optical signal to extract and identification code and a cryptographic key; to enable the wireless communication module such as to establish a wireless communication link between the wireless communication module and the signal source if the extracted code matches a reference code; and to encrypt data sent over the wireless communication link in accordance with said cryptographic key.

The present invention is based on the insight that the combination of a directional optical signal and source information, i.e. information provided by the source of the signal, embedded in the directional signal may be used to select specific luminaires, i.e. by aiming the directional signal at the luminaire, with the information in the directional signal being used by the wireless communication module to establish a secure wireless communication link between the luminaire and the source of the signal, e.g. a smart device such as a wireless communications device, e.g. a mobile phone, a tablet computer or the like.

Preferably, the signal detector comprises an optical sensor and the directional signal comprises a directional optical signal as such optical signals, e.g. infrared (IR) or visible (VIS) signals, are particularly suited for generating directional signals, e.g. light beams having a high degree of collimation.

Attention is drawn on the fact that only wireless communications with authorized signal sources, i.e. sources identified by a recognized code, are established, thereby improving the security of the wireless communication link between the luminaire and such signal sources.

In an embodiment, the luminaire stores at least one identification key, and wherein the controller is adapted to transmit the at least one identification key using the wireless communication module in response to the directional signal. In this manner, subsequent wireless communication between the source and the luminaire may be directed to the target luminaire, e.g. in a multi-luminaire environment, by using the identification key, e.g. MAC address, IP address or the like, as provided by the target luminaire.

The controller may be adapted to enable the wireless communication module by allowing the wireless communication module to initiate the wireless communication link in response to said directional signal. Alternatively, the controller may be adapted to enable the wireless communication module by completing an authorization of an initiated wireless communication with the wireless communication module based on the source information in response to said directional signal.

According to another aspect, there is provided a method of establishing a wireless communication link with a luminaire comprising a wireless communication module for programming the luminaire, an optical signal detector and a controller for controlling the wireless communication module, wherein the controller is adapted to enable the wireless communication module in response to a directional optical signal detected with the optical signal detector. The method comprises transmitting a directional optical signal with a source to the luminaire, said signal including source information including an identification code and a cryptographic key; decoding, on the luminaire side, of the received directional optical signal for retrieving the identification code and the cryptographic key; and establishing a wireless communication link encrypted with the cryptographic key with the luminaire in response to the luminaire controller if the identification code matches a reference code.

Such a method may be deployed by a source such as a smart device, such as a wireless communications device, e.g. a mobile phone, a tablet computer or the like, in order to establish a secure wireless connection link with a luminaire targeted with the directional signal, i.e. a luminaire at which the directional signal is aimed.

Establishing the wireless communication with the luminaire may comprise initializing said wireless communication prior to transmitting the directional signal; and completing said initialization in response to the luminaire controller enabling its wireless communication module, e.g. based on the source information provided in the directional signal.

In an embodiment, transmitting the directional signal comprises transmitting a coded directional optical signal comprising the source information in said code. Such optical signals, e.g. IR or VIS signals, are particularly suited for creating directional signals, e.g. highly collimated optical signals.

Preferably, establishing said wireless communication link comprises establishing an encrypted wireless communication in order to enhance the security of the communication between the source and the luminaire. For example, establishing said encrypted wireless communication may comprise transmitting a random cryptographic key as first cryptographic key to the luminaire; receiving a device identification key from the luminaire; transmitting the device identification key to a remote service; receiving a further cryptographic key associated with the device identification key from the remote service; and transmitting a data packet encrypted with the random cryptographic key and the further cryptographic key to the luminaire to establish a particularly secure wireless communication link between the source and the luminaire.

According to yet another aspect, there is provided a computer program product comprising a computer readable storage medium having computer readable program instructions embodied therewith for, when executed on a processing arrangement of a mobile communications device further comprising a directional signal source under control of the processing arrangement, the processing arrangement adapted to execute the computer readable program instructions, cause the processing arrangement to implement the method of any of herein described embodiments. Such a computer program product, e.g. an app in an app store or the like, may be used to configure a source, e.g. smart device, such as a wireless communications device, e.g. a mobile phone, a tablet computer or the like, to implement this secure communication method with a luminaire according to embodiments of the present invention.

According to still another aspect, there is provided a mobile communications device comprising a processing arrangement, a directional signal source under control of the processing arrangement, and the aforementioned computer program product, wherein the processing arrangement is adapted to execute the computer readable program instructions embodied by said computer program product in order to implement the secure communication method with a luminaire according to embodiments of the present invention.

BRIEF DESCRIPTION OF THE DRAWINGS

Embodiments of the invention are described in more detail and by way of non-limiting examples with reference to the accompanying drawings, wherein.

DETAILED DESCRIPTION OF THE EMBODIMENTS

Figure 1:
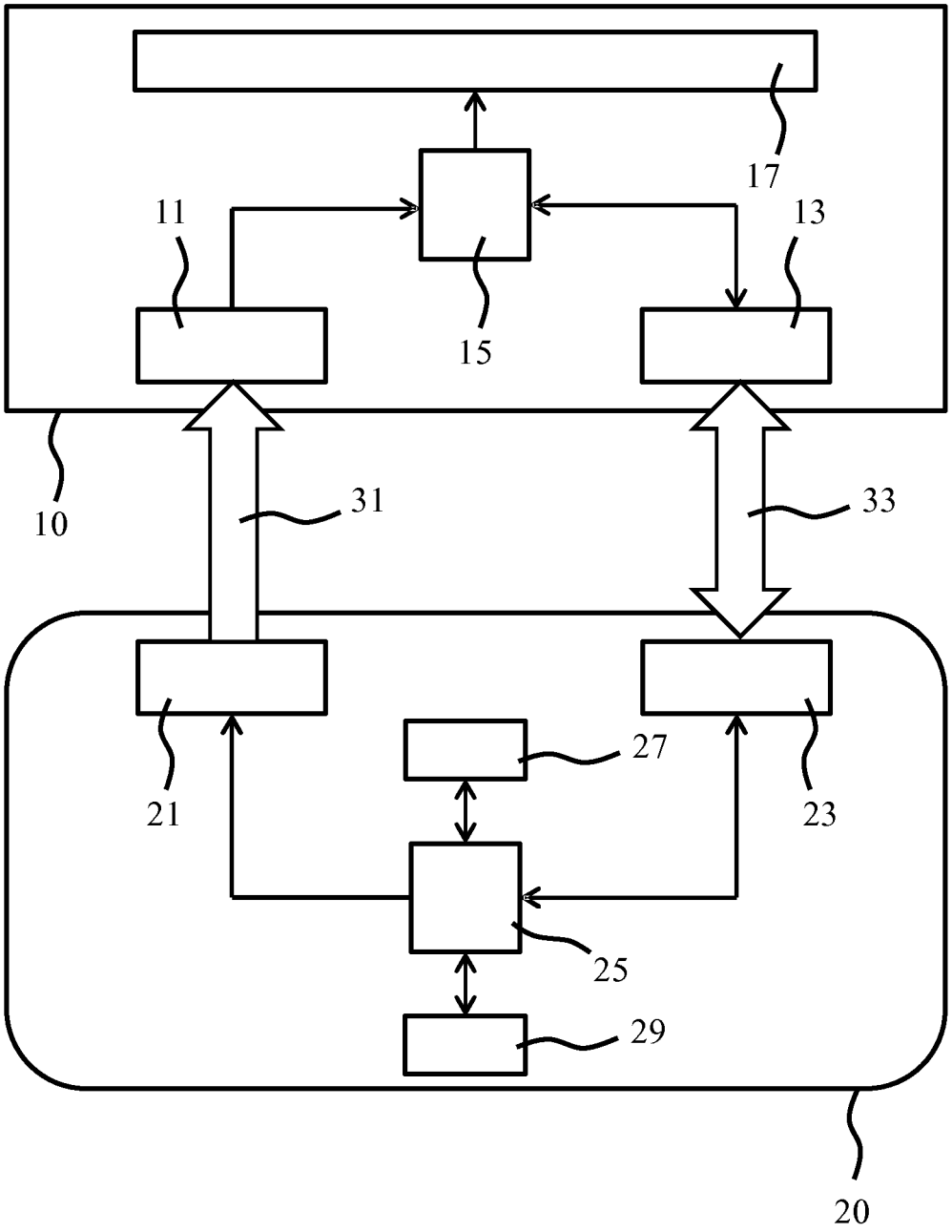
FIG. 1 schematically depicts a luminaire and source according to an embodiment of the present invention.

It should be understood that the Figures are merely schematic and are not drawn to scale. It should also be understood that the same reference numerals are used throughout the Figures to indicate the same or similar parts.

FIG. 1 schematically depicts a communication arrangement between a luminaire 10 and a source 20, such as a mobile communication device, e.g. a smart phone or a tablet computer for instance, although other types of sources, e.g. a laptop computer and so on, may also be contemplated. The luminaire 10 typically comprises a signal detector 11 and a wireless communication module 13 communicatively coupled to a controller 15, which controller 15 may be further arranged to control a light engine 17 of the luminaire 10. The controller 15 of the luminaire 10 may be any suitable controller, e.g. a microprocessor, ASIC, a suitably programmed general-purpose processor and so on. The embodiment of the light engine 17 is not particularly limited and may be any suitable light engine, e.g. may include one or more solid state lighting devices such as LEDs as well as one or more optical elements for shaping the luminous output of the light engine 17.

The source 20 typically comprises a directional signal generator 21 under control of a processing arrangement 25 for generating a directional signal 31 including source information to be received by the signal detector 11 of the luminaire 10. The directional signal 31 in some embodiments is an optical signal such as a (collimated) IR signal in a frequency band of 36-38 KHz or a VIS signal, although other types of directional signals may also be contemplated. The directional signal 31 typically establishes a unidirectional communication channel between the source 20 and the luminaire 10, i.e. a communication channel from the source 20 to the luminaire 10 over which information such as identification information or encryption information may be provided to the luminaire 10 by the source 20. Due to the fact that this unidirectional communication channel is directional in nature, i.e. typically is only received by the luminaire 10 at which the directional signal 31 is aimed by a user of the source 20, e.g. an installer or programmer of the luminaire 10, other sources in the vicinity of the source 20 will be unable to capture the information embedded in the directional signal 31, such that this information may be used by the luminaire 10 to establish a wireless communication with the intended source 20, i.e. The source 20 providing the directional signal 31. In some embodiments, the directional signal generator 21 may be a laser pointer, an IR blaster device, or the like although alternative suitable embodiments of such directional signal generators will be immediately apparent to the skilled person. The directional signal generator 21 may be adapted to generate a modulated directional signal, e.g. Ea modulated directional optical signal, to avoid accidental activation of the wireless communication module 13 of the luminaire 10. In this embodiment, the controller 15 of the luminaire 10 may extract and evaluate the modulation from the directional signal 31 received with the signal detector 11 and may only enable the wireless can indication module 13 in case this modulation corresponds to a defined modulation signaling a wireless communication initiation by a source, e.g. the source 20.

The source 20 typically further comprises a wireless communication module 23 under control of the processing arrangement 25 for establishing a bidirectional wireless communication link 33 with the wireless communication module 13 of the luminaire 10. Such a wireless communication link 33 may be established in accordance with any suitable wireless communication protocol, e.g. Bluetooth, Zigbee, Wi-Fi, and so on. P2P protocols such as Bluetooth and Zigbee are particularly suitable. The processing arrangement 25 of the source 20 may be any suitable processing arrangement, e.g. one or more processors such as a CPU, GPU and the like, which may have any suitable configuration or design.

The source 20 may further comprise a data storage device 27 such as a memory, a hard disk, a solid state disk, and so on, communicatively coupled to the processing arrangement 25. In an embodiment, the data storage device 27 may embody a computer readable storage medium of a computer program product storing computer readable program instructions, when executed on the processing arrangement 25, causing the source 20, i.e. The processing arrangement 25, to implement aspects of a communication method with the luminaire 10 according to embodiments of the present invention as will be described in more detail below.

The source 20 may further comprise one or more user interfaces 29 communicatively coupled to the processing arrangement 25, e.g. for providing user instructions to the processing arrangement 25. Such user instructions for example may be used to configure the communication between the source 20 and the luminaire 10. Any suitable type of user interface 29 may be used for this purpose; for example, the user interface 29 may include at least one of a touchscreen, a keypad, a mouse pad, a microphone (e.g. when the processing arrangement 25 is hosting a speech recognition application), a camera (e.g. when the processing arrangement 25 is hosting a gesture recognition application), and so on. Many other suitable user interfaces will be immediately apparent to the skilled person.

The signal detector 11 of the luminaire 10 is typically adapted to detect the directional signal 31 generated by the directional signal generator 21 of the source 20. For example, in case of an optical signal such as IR or VIS signal, the signal detector 11 may comprise an optical sensor such as a photocell or any other suitable type of optical sensor for detecting the directional signal 31. The signal detector 11 may be adapted to pass the directional signal 31 to the controller 15 for processing. Alternatively, the signal detector 11 may perform some pre-processing, e.g. noise filtering, on the directional signal before passing the signal onto the controller 15. In yet another embodiment, the signal detector 11 may be adapted to perform at least part of the processing of the directional signal 31 and pass a (partial) processing result onto the controller 15. In an embodiment, the signal detector 11 is mounted on the same carrier as the light engine 17, e.g. a PCB carrying a plurality of LEDs, such that the signal detector 11 can 'view' the outside world through the light exit window of the luminaire 10, thus providing a direct line of sight to the signal detector 11, which is particularly advantageous in case of the directional signal 31 being an optical signal. The wireless communication module 13 equally may be mounted on this carrier for similar reasons.

The controller 15 may be adapted to only engage in establishing a bidirectional wireless communication link 33 with a source 20 upon receiving an indication of the signal detector 11 that a directional signal 31 has been received. Specifically, the controller 15 may enable the wireless communication module 13, e.g. wake up or otherwise power up the wireless communication module 13 in response to the directional signal 31. For example, in case of a Bluetooth wireless communication module 13, the controller 15 may trigger the initiation of a Bluetooth Low Energy (BLE) advertisement with the wireless communication module 13, e.g. in accordance with the Bluetooth 4.0 standard, which may trigger several Bluetooth devices including the source 20 to respond to the BLE advertisement, with the controller 15 selecting the source 20 for establishing the wireless connection 33 based on the information provided by the source 20 in the directional signal 31. In this embodiment, this information for example may comprise a device identifier of the source 20 or the like, e.g. a MAC address, IP address or the like, based on which the controller 15 may establish the wireless connection 33 with the source 20 responding to the BLE advertisement. Alternatively, the controller 15 of a luminaire 10 may allow initiation of the establishment of a wireless communication link 33 with a source 20 prior to receiving the directional signal 31 from the source 20, but only allow completion of the establishment of the wireless communication link 33 following receipt of the directional signal 31 from the source 20, e.g. following verification of the information embedded into the directional signal 31 by the source 20.

Figure 2:
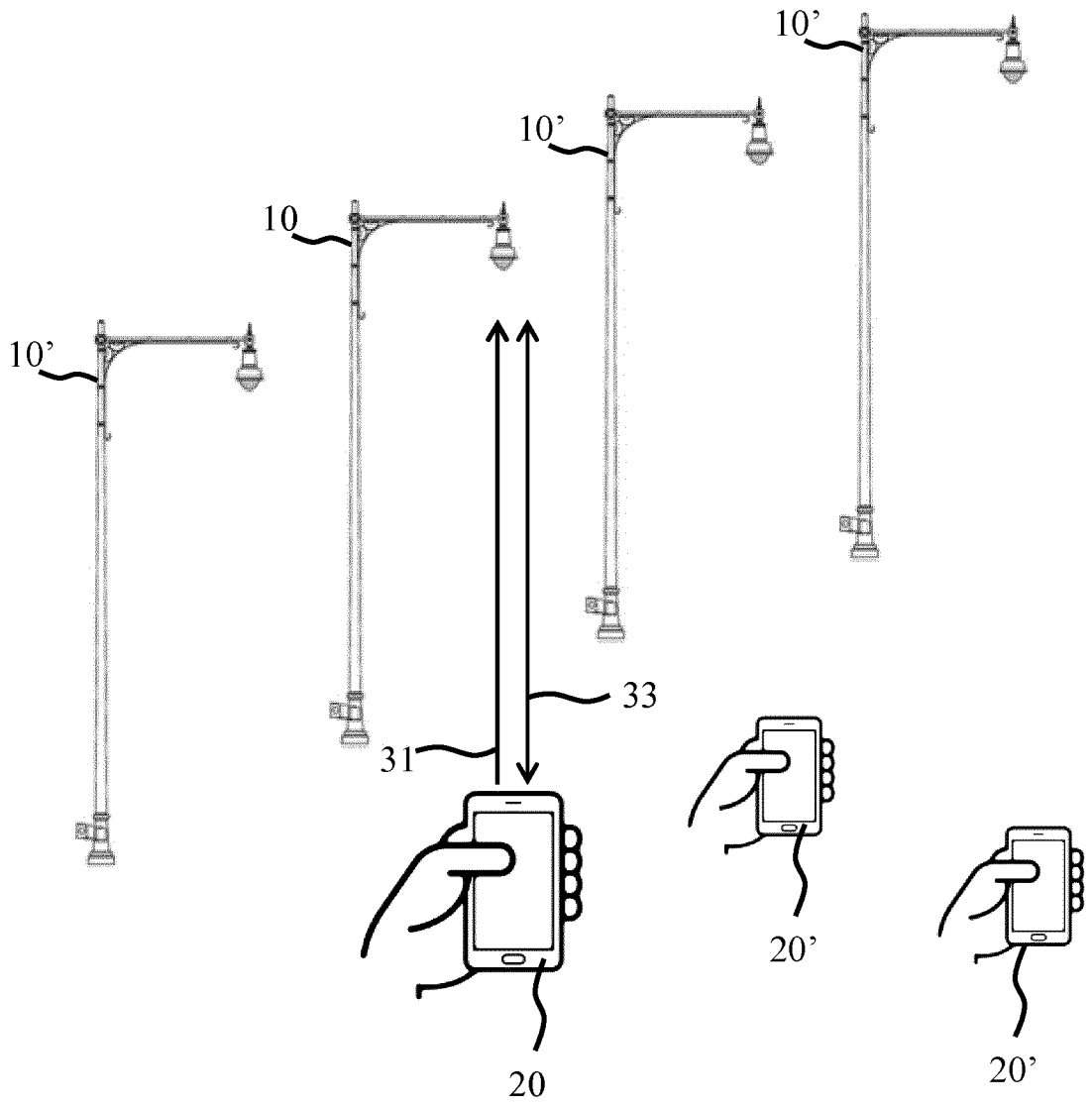
FIG. 2 schematically depicts a use case of a luminaire and source according to an embodiment of the present invention.

FIG. 2 schematically depicts an example use case of the present invention, in which the luminaires 10, 10' are outdoor luminaires, e.g. street lamps, to which installer using sources 20, 20' cannot gain easy access, here because of the installation height of the luminaires 10, 10'. The aforementioned communication method between the source 20 and the luminaire 10, i.e. by establishing a unidirectional connection 31 from the source 20 to the luminaire 10 followed by the establishment of a wireless bidirectional connection 33 between the luminaire 10 and the source 20 ensures that the source 20 can selectively connect to the luminaire 10, thereby avoiding inadvertent connecting to any of the neighboring luminaires 10', whereas the coded nature of at least the unidirectional connection 31 makes it more difficult for neighboring sources 20', e.g. malicious sources, to eavesdrop or otherwise interfere with the communication link between the luminaire 10 and the source 20.

At this point, it is noted for the avoidance of doubt that embodiments of the present invention are not limited to this particular outdoor use case. The teachings of the present invention are equally applicable in any scenario where a plurality of luminaires 10 are present within wireless communicatively range of a source 20. Examples of alternative scenarios include luminaires in meeting rooms, hotels and hotel rooms, restaurants, shops, museums, hospitals, public places, parking lots, event or exhibition venues, public transport, industrial environments, and so on. In general, the teachings of the present invention for instance may be applied to any setting in which a plurality of luminaires 10 may be accessed by multiple sources 20, e.g. to commission and/or configure the luminaires 10 or unlock subscription features in the luminaires 10 as previously explained.

Figure 3:
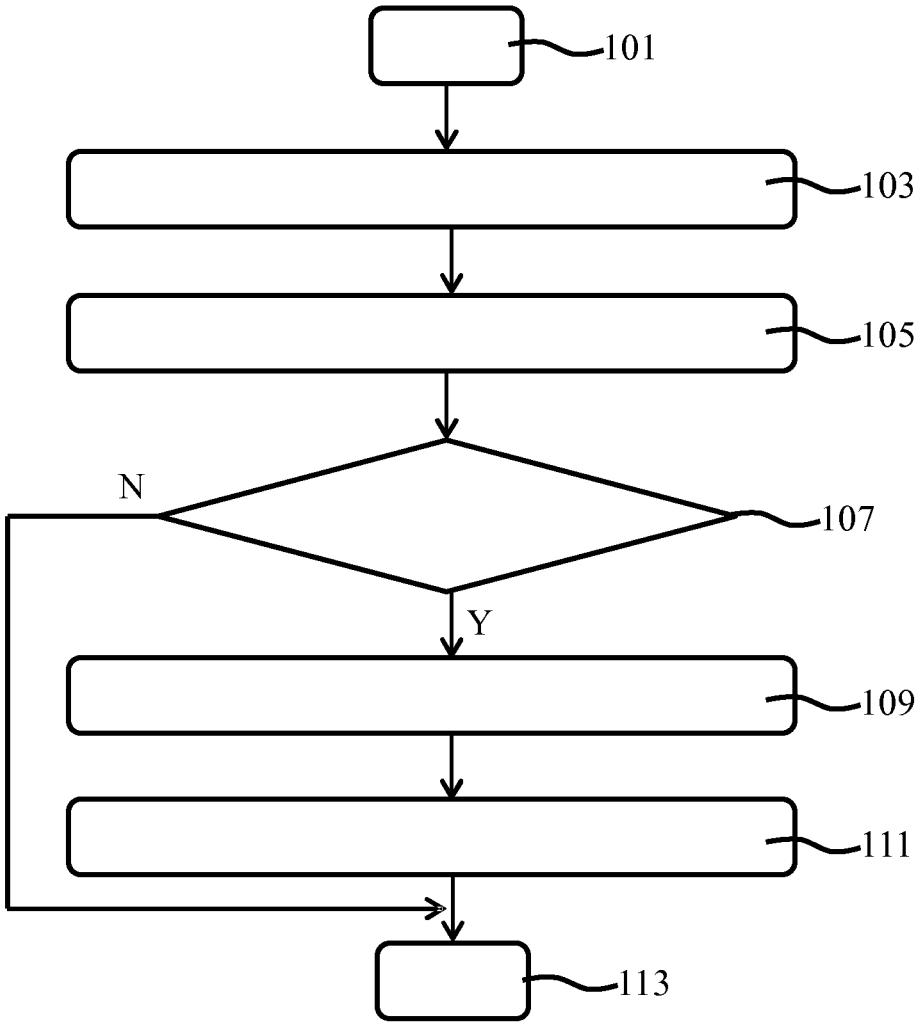
FIG. 3 schematically depicts an aspect of a luminaire communication method according to an embodiment.
Figure 4:
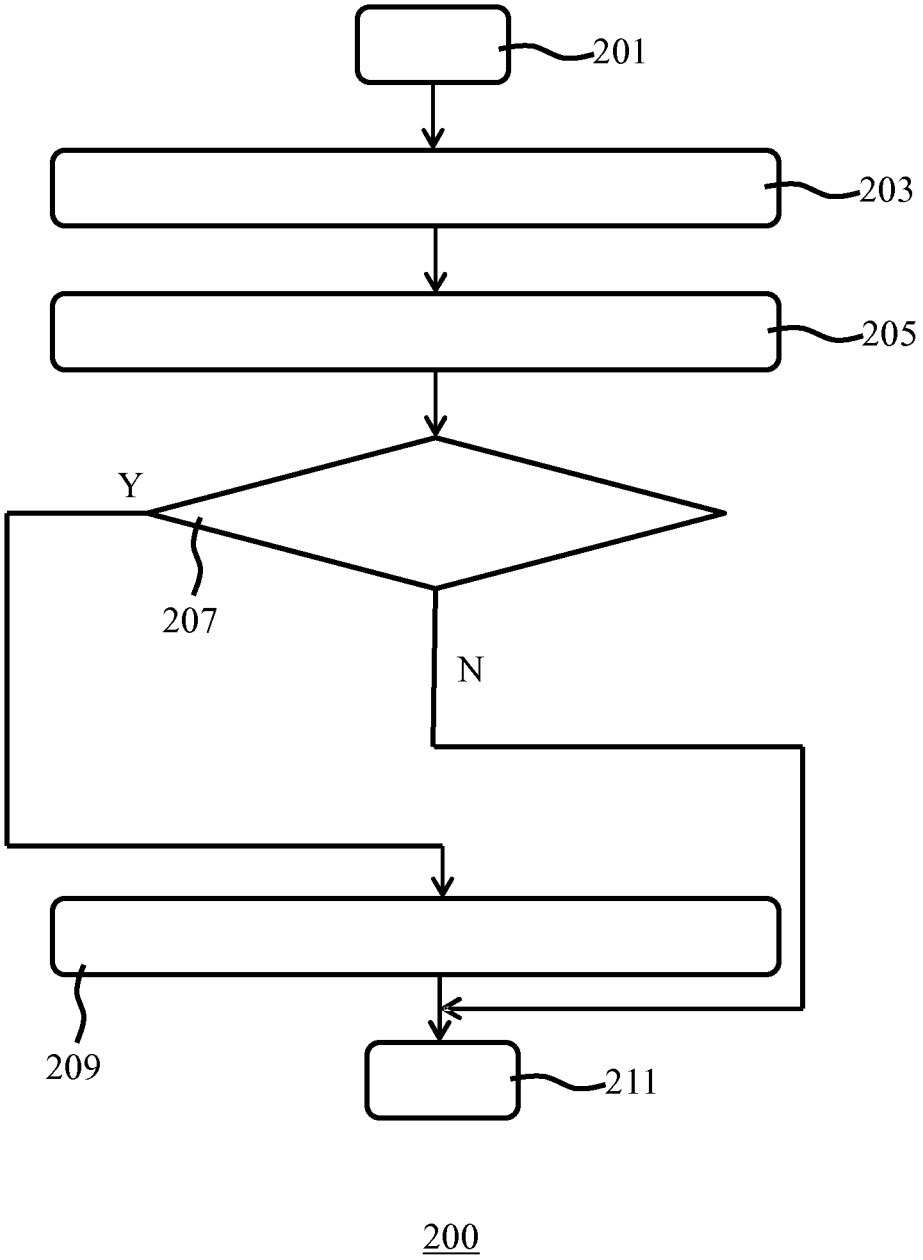
FIG. 4 schematically depicts another aspect of a luminaire communication method according to an embodiment.

An example embodiment of a communication method between a luminaire 10 and a source 20 will now be explained in more detail with the aid of the flowchart of FIG. 3, which depicts the method 100 performed by the luminaire 10 and the flowchart of FIG. 4, which depicts the method 200 performed by the source 20. The luminaire 10 starts in 101 and the source 20 starts in 201, e.g. by powering up the luminaire 10 and the source 20 respectively. Next, a user of the source 20 may aim the source 20, i.e. the directional signal 31, at the luminaire 10 to be selected in 203, causing the transmission of the directional signal 31, e.g. Ea directional optical signal, including coded information by which the source 20 may be identified, towards the luminaire 10, which may receive the directional signal 31 in 103 with the signal detector 11.

Next, the controller 15 may extract the coded information from the directional signal 31 received from the signal detector 11 in 105, e.g. by decoding a modulation in the directional signal 31 or in any other suitable manner, and checks in 107 if the extracted information matches an expectation value of the information, e.g. belongs to a list of 'approved' information values that indicate that the source 20 may be granted wireless access to the luminaire 10 before proceeding to 109 or terminating in 113 in case of the information having an unexpected value. Alternatively, the controller 15 may store the extracted information and use the information at a later stage, e.g. during the wireless communication with the source 20, to determine if information provided by the source 20 over the wireless communication link 33 matches the information provided in the directional signal 31, to confirm that it is the same source 20 establishing the wireless communication link 33, or as will be explained in more detail below, use the information provided in the directional signal 31 to encode data communicated over the wireless communication link 33.

Next, the controller 15 may enable the wireless communication module 13 in 109, for instance when determining that the information extracted from the directional signal 31 is indicative of the source 20 being entitled to gain access to the luminaire 10. In an embodiment, the wireless communication module 13 may include the information extracted from the directional signal 31 in a wireless communication invitation broadcast. The source 20 may receive the wireless communication invitation broadcast in 205 and optionally may check in 207 whether information included in this broadcast matches the previously provided information in the directional signal 31 before accepting the wireless communication invitation from the luminaire 10 in 209 and/or terminating the method 200 in 211. Upon the source 20 accepting the wireless communication invitation, the luminaire 10 may complete establishing the wireless communication link 33 in 111 before terminating in 113.

Figure 5:
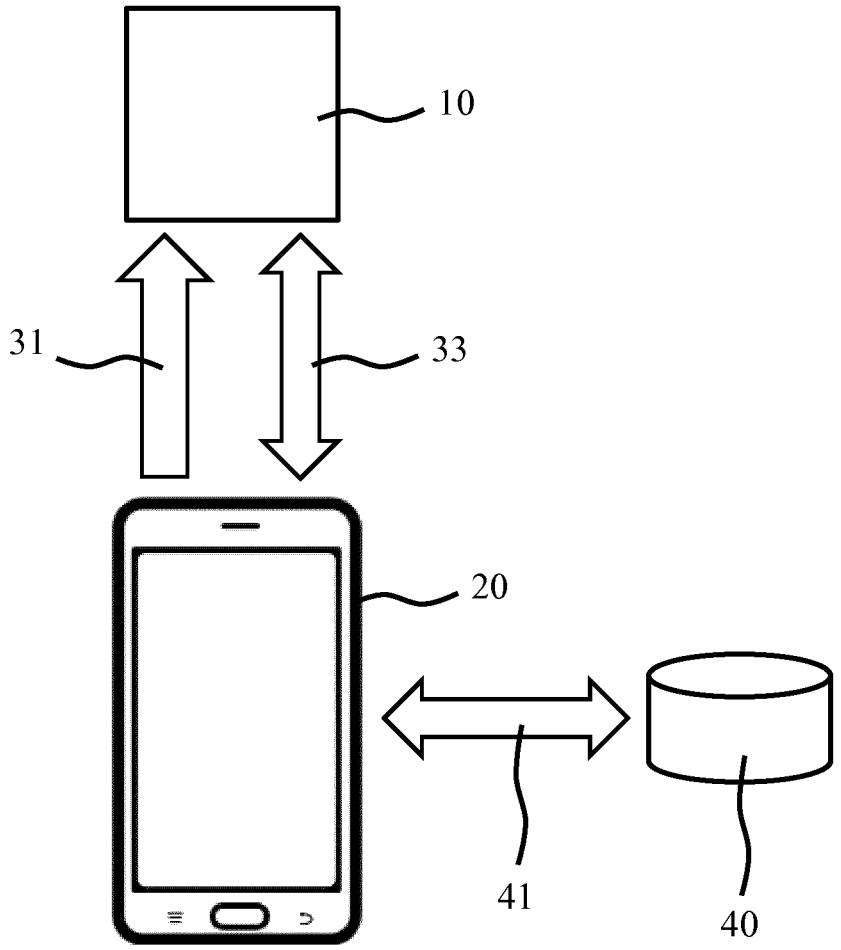
FIG. 5 schematically depicts a use case of a luminaire and source according to another embodiment of the present invention.

In a particularly advantageous embodiment, the source 20 and the luminaire 10 may establish a wireless communication link 33 over which data is communicated in an encrypted fashion to further bolster the security of the data communication between the source 20 and the luminaire 10. An example embodiment of such an arrangement is schematically depicted in FIG. 5, in which the source 20 during the establishment of the wireless communication link 33 with the luminaire 10 may at least temporarily connect to a database 40 over a further communication link 41, e.g. a further wireless communication link established with the wireless communication module 23 or a further wireless communication module, e.g. a radio for establishing an Internet or other suitable connection with the database 40. The database 40 contains cryptographic key information for a plurality of luminaires 10, e.g. for each luminaire 10 of a particular manufacturer, a copy of a private cryptographic key as present in the luminaire 10 is stored in the database, and may be identified using a unique identifier of the luminaire 10 such as a MAC address or physical address, an IP address or the like. The database 40 may be a remote database as previously explained. Alternatively, the database 40 may at least be partially stored on the source 20, for example to facilitate off-line use of the source 20 when the communication link 41 cannot be guaranteed. In this embodiment, the device key data of the luminaire 10 preferably is stored on the source 20 in a secure manner, for example by employing well-known techniques such as file encryption, e.g. using a user-defined key.

Figure 6:
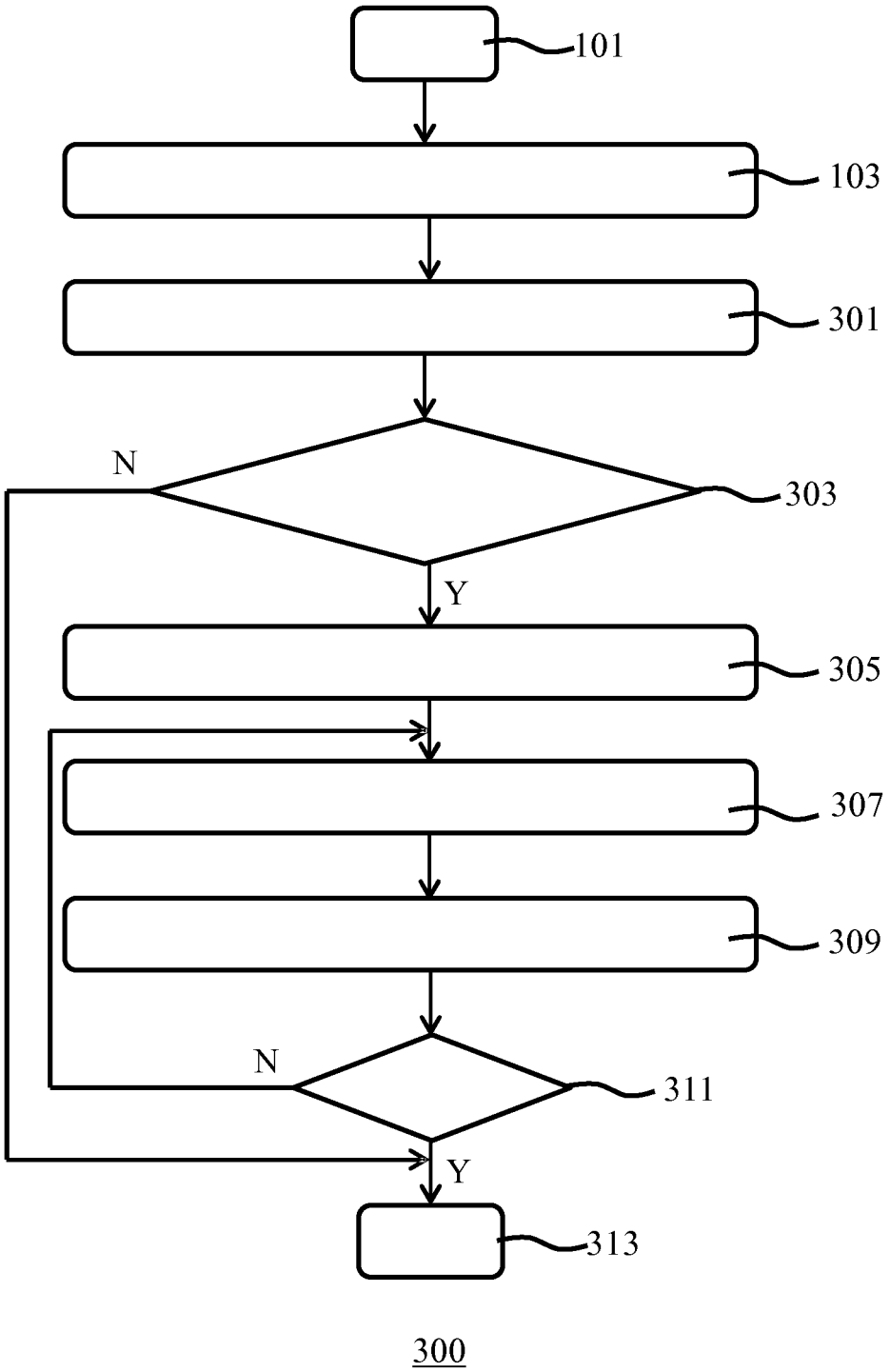
FIG. 6 schematically depicts an aspect of a luminaire communication method according to another embodiment.
Figure 7:
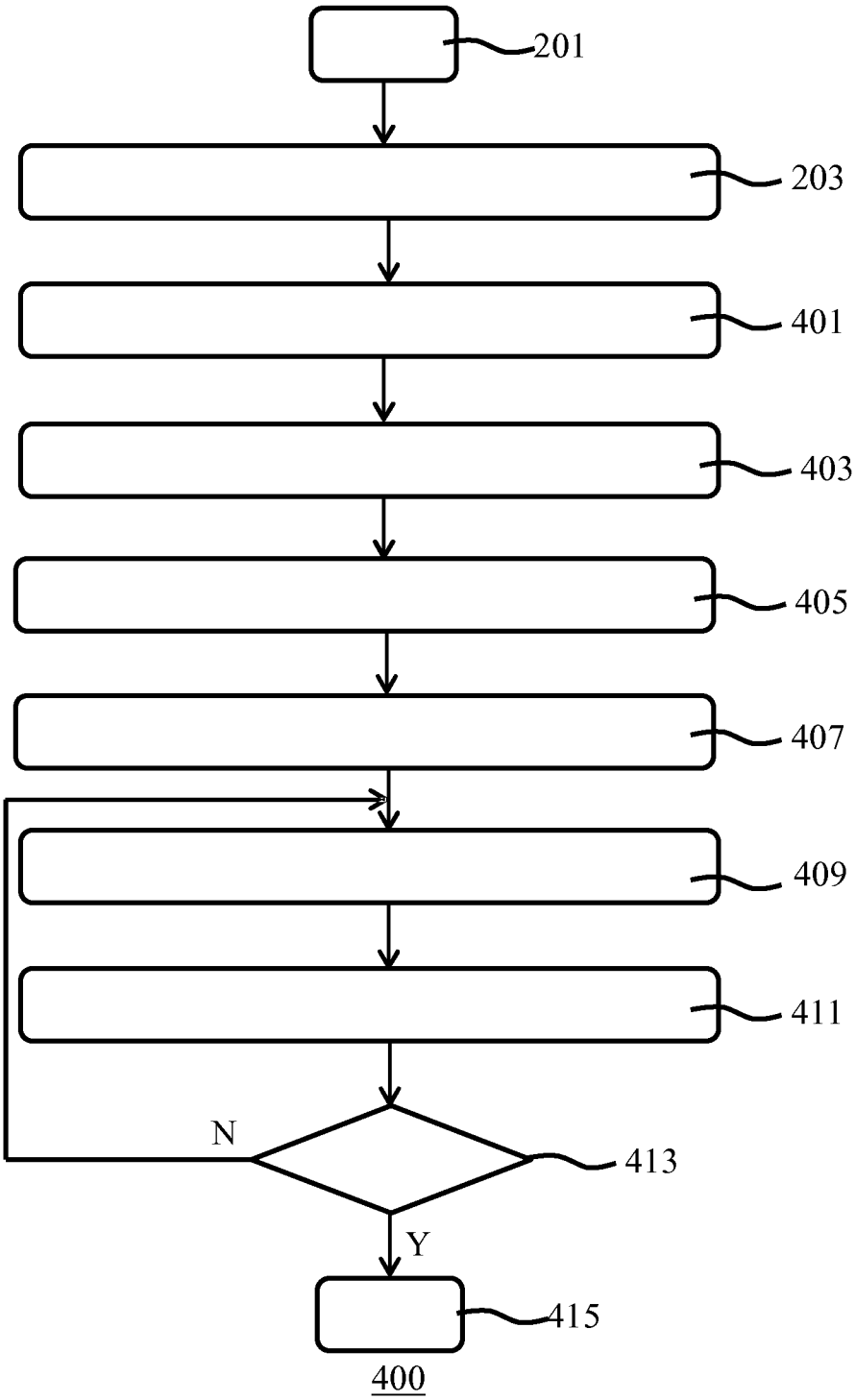
FIG. 7 schematically depicts another aspect of a luminaire communication method according to another embodiment.

FIG. 6 is a flowchart of an example embodiment of the method 300 performed by the luminaire 10 in establishing such an encrypted wireless communication link 33 and FIG. 7 is a flowchart of an example embodiment of the method 400 performed by the source 20 in establishing such an encrypted wireless communication link 33. The method 300 and the method 400 may respectively start in 101 and 201, which may be identical as described above. Next, the source 20 transmits the directional signal 31 in 203 as previously explained. In an embodiment, the information coded in the directional signal 31 by the source 20 may be a random cryptographic key, which, upon receipt of the directional signal 31 in 103 may be extracted from the directional signal 31 by the controller 15 and stored in memory (not shown) or the like. Alternatively, the information may be an identifier or the like of the source 20 as previously explained. In response to receiving the directional signal 31, the controller 15 triggers the wireless communication module 13 of the luminaire 10 to send a wireless communication invitation broadcast such as a BLE request in 301 and may check in 303 if a response to this request is received by the wireless communication module 13 before a time-out of the invitation. Such a time-out for example may be desirable to reduce the risk of the wireless connection 33 being hijacked by a further source. In the meantime, the wireless communication module 23 of the source 20 may receive the wireless communication invitation broadcast from the wireless communication module 13 of the luminaire 10, which may include a luminaire identifier, e.g. MAC address, IP address or the like. The processing arrangement 25 of the source 20 may use a pre-existing whitelist of unique device IDs to recognize the luminaire identifier and establish the wireless connection 33 in 403 with the wireless communication module 23. At this stage, the source 20 may also send the random cryptographic key if this key was not previously provided in the directional signal 31.

In response to timely receiving the acceptance of its wireless communication invitation broadcast by the source 20, the luminaire 10 may confirm the reception of the random cryptographic key and send a unique device ID to the source 20 over the wireless communication link 33 in 305. Alternatively, the sending of this unique device ID may be skipped if the source 20 may use the device ID provided in the wireless communication invitation broadcast. The source 20 may receive the unique device ID of the luminaire 10 through its wireless communication module 23 in 405, which may trigger the processing arrangement 25 to connect the database 40 over the further wireless communication link 41 as previously explained in order to retrieve the private cryptographic key of the luminaire 10 in 407 by sending the received unique device ID of the luminaire 10 to the database 40 over the further wireless communication link 41 and receiving the private cryptographic key of the luminaire 10 in response from the database 40.

The source 20 is now ready to commence encrypted communication with the luminaire 10 by encrypting data packets with its random cryptographic key provided to the luminaire 10 and the private cryptographic key of the luminaire 10 as a received from the database 40 in 409 and send the encrypted data packets to the luminaire 10 over the wireless communication link 33 in 411. In response, the luminaire 10 receives the encrypted data packets with its wireless communication module 13 over the wireless communication link 33 in 307, after which the encrypted data packet is forwarded to the controller 15, which decrypts the data packet with its private cryptographic key and the random cryptographic key previously received from the source 20 in 309. Although not specifically shown in FIGS. 6 and 7, in case the source 20 has requested data from the luminaire 10, the luminaire 10 may provide such data in encrypted form using its private cryptographic key and the random cryptographic key previously received from the source 20 for decoding by the processing arrangement 25 of the source 20 as will be readily understood by the skilled person. In addition, the skilled person will readily understand that the luminaire 10 and the source 20 may both send and receive encrypted data using the encryption keys established in the previous process steps. For example, the source 20 may use such encrypted communication either as a means to change setting parameters (e.g. light level or schedule information) of the luminaire 10, whereas the luminaire 10 may deploy encrypted communication over the wireless communication link 33 to provide metering data to the source 20, e.g. amount of kWh used. Such metering data may be provided in response to a request from the source 20 for such data, which request may also be provided in encrypted form.

Next, the controller 15 of the luminaire 10 checks in 311 and/or the processing arrangement 25 of the source 20 checks in 413 if the wireless communication link 33 is to be terminated. If this is not the case, the sending of encrypted data as previously explained may continue; otherwise, the methods 300 and 400 may respectively terminate in 313 and 415.

At this stage, it is noted that in some embodiments, the source 20 may be adapted to periodically update its random cryptographic key and send this updated random cryptographic key to the luminaire 10, e.g. using the directional signal 31 or the wireless communication link 33, to further enhance the security of the communication over the wireless communication link 33.

Aspects of the present invention may be embodied as a luminaire 10, a source 20 configured to communicate with such a luminaire 10 and methods or computer program products for implementing such communication between the luminaire 10 and the source 20. Aspects of the present invention may take the form of a computer program product embodied in one or more computer-readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. Such a system, apparatus or device may be accessible over any suitable network connection; for instance, the system, apparatus or device may be accessible over a network for retrieval of the computer readable program code over the network. Such a network may for instance be the Internet, a mobile communications network or the like.

More specific examples (a non-exhaustive list) of the computer readable storage medium may include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of the present application, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out the methods of the present invention by execution on a processor of a computer system may be written in any combination of one or more programming languages, including an object oriented programming language such as Java, Smalltalk, C++ or the like and conventional procedural programming languages, such as the "C" programming language or similar programming languages. The program code may execute entirely on the processor as a stand-alone software package, e.g. an app, or may be executed partly on the processor and partly on a remote server. In the latter scenario, the remote server may be connected to the processor through any type of network, including a local area network (LAN) or a wide area network (WAN), or the connection may be made to an external computer, e.g. through the Internet using an Internet Service Provider.

Aspects of the present invention are described above with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions to be executed in whole or in part on the processor of a computer system, such that the instructions create means for implementing the functions/acts specified in the flowchart and/or block diagram block or blocks. These computer program instructions may also be stored in a computer-readable medium that can direct the processor to function in a particular manner.

The computer program instructions may be loaded onto the processor to cause a series of operational steps to be performed on the processor to produce a computer-implemented process such that the instructions which execute on the processor provide processes for implementing the functions/acts specified in the flowchart and/or block diagram block or blocks. The computer program product may form part of the source 20.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. A luminaire comprising:

a wireless communication module for configuring the luminaire;

an optical signal detector for detecting a directional optical signal comprising source information included in the directional optical signal by a signal source of the directional optical signal; and a controller for controlling the wireless communication module, characterized in that the controller is adapted to:

decode the source information of the coded directional optical signal to extract an identification code or a cryptographic key;

enable the wireless communication module such as to establish a wireless communication link between the wireless communication module and the signal source if the extracted identification code matches a reference code; or encrypt data sent over the wireless communication link in accordance with said cryptographic key.

2. The luminaire of claim 1, wherein the luminaire stores at least one identification key, and wherein the controller is adapted to transmit the at least one identification key using the wireless communication module in response to the directional signal.

3. The luminaire of claim 1, wherein the controller is adapted to enable the wireless communication module by allowing the wireless communication module to initiate a wireless communication link in response to said directional signal.

4. The luminaire of claim 1, wherein the controller is adapted to enable the wireless communication module by completing an authorization of an initiated wireless communication link with the wireless communication module based on the source information in response to said directional optical signal.

5. A method of establishing a communication with a luminaire comprising a wireless communication module for programming the luminaire, an optical signal detector and a controller for controlling the wireless communication module, wherein the controller is adapted to enable the wireless communication module in response to a directional optical signal detected with the optical signal detector, characterized in that the method comprising:

transmitting the directional optical signal with a signal source to the luminaire, the directional signal including source information including an identification code or a cryptographic key;

decoding, on the luminaire side, of the received directional optical signal for retrieving the identification code or the cryptographic key; and establishing a wireless communication link with the luminaire in response to the luminaire controller if the identification code matches a reference code; or establishing a wireless communication link encrypted with the cryptographic key with the luminaire in response to the luminaire controller.

6. The method of claim 5, wherein establishing said wireless communication with the luminaire comprises:

initializing said wireless communication link prior to transmitting the directional signal; and completing said initialization in response to the luminaire controller enabling its wireless communication module.

7. The method of claim 5, further comprising:

receiving an identification key from the luminaire in response to transmitting the directional signal; and establishing said wireless communication using said identification key.

8. The method of claim 5, wherein the cryptographic key is a random cryptographic key and wherein establishing said encrypted wireless communication link comprises: receiving a device identification key from the luminaire;

transmitting the device identification key to a remote service;

receiving a further cryptographic key associated with the device identification key from the remote service; and transmitting a data packet encrypted with the random cryptographic key and the further cryptographic key to the luminaire.

9. A computer program product comprising a non-transitory computer readable storage medium having computer readable program instructions configured to, when executed on a processing arrangement of a mobile communications device further comprising a directional signal source under control of the processing arrangement, the processing arrangement adapted to execute the computer readable program instructions:

transmit the directional optical signal with a signal source to a luminaire, the directional signal including source information including an identification code or a cryptographic key;

decode, on the luminaire side, the received directional optical signal for retrieving the identification code or the cryptographic key; and establish a wireless communication link with the luminaire in response to a luminaire controller if the identification code matches a reference code; or establish a wireless communication link encrypted with the cryptographic key with the luminaire in response to the luminaire controller.

10. A mobile communications device comprising a processing arrangement, a directional signal source under control of the processing arrangement, and the computer program product of claim 9, wherein the processing arrangement is adapted to execute the computer readable program instructions embodied by said computer program product.

* * * * *